US011219818B1

(12) United States Patent
Yakos et al.

(10) Patent No.: US 11,219,818 B1
(45) Date of Patent: Jan. 11, 2022

(54) COLLAPSIBLE POLYHEDRON

(71) Applicants: David Yakos, Bozeman, MT (US); Timothy Walsh, Sarasota, FL (US)

(72) Inventors: David Yakos, Bozeman, MT (US); Timothy Walsh, Sarasota, FL (US)

( * ) Notice: Subject to any disclaimer, the term of this patent is extended or adjusted under 35 U.S.C. 154(b) by 0 days.

(21) Appl. No.: 17/141,080

(22) Filed: Jan. 4, 2021

(51) Int. Cl.
*A63F 9/04* (2006.01)
*G08B 7/06* (2006.01)

(52) U.S. Cl.
CPC ..... *A63F 9/0415* (2013.01); *A63F 9/0413* (2013.01); *G08B 7/06* (2013.01); *A63F 9/04* (2013.01); *A63F 2009/0422* (2013.01); *A63F 2009/0426* (2013.01); *A63F 2009/0431* (2013.01); *A63F 2009/0437* (2013.01); *A63F 2009/0444* (2013.01); *A63F 2009/0446* (2013.01); *A63F 2009/0455* (2013.01); *A63F 2009/0464* (2013.01); *A63F 2009/0491* (2013.01)

(58) Field of Classification Search
CPC .. A63F 2009/0437; A63F 9/04; A63F 9/0413; A63F 9/0415; A63F 2009/0491; A63F 2009/0422; A63F 2009/0426; A63F 2009/0431; A63F 2009/0466; A63F 2009/0444; A63F 2009/0455
USPC ..... 273/146
See application file for complete search history.

(56) References Cited

U.S. PATENT DOCUMENTS 4,124,881 A * 11/1978 Haber ..... A63F 9/0415 362/253
4,682,726 A 7/1987 Drueck, Jr.
4,790,714 A * 12/1988 Schnapp ..... A63H 33/16 446/486
2004/0160000 A1* 8/2004 Lindsey ..... A63F 9/0468 273/146
2005/0164778 A1* 7/2005 Cooney ..... A63F 9/0468 463/22
2009/0206548 A1* 8/2009 Hawkins ..... A63F 9/0468 273/146
2017/0333782 A1* 11/2017 Fjelstad ..... A63F 9/0415

FOREIGN PATENT DOCUMENTS

GB 2202159 A * 9/1988 ..... A63F 9/0415

* cited by examiner

*Primary Examiner* — Benjamin Layno
(74) *Attorney, Agent, or Firm* — Quickpatents, LLC; Kevin Prince

(57) ABSTRACT

A collapsible, self-expanding polyhedron comprises a plurality of side members each connected with an elastic band that is sized to urge each side wall of adjacent side members together to form an expanded configuration. When the polyhedron is compressed on two opposing side members, which causes the other side members to separate into a collapsed configuration, the elastic band expands to a maximum length with maximum tension. Once the compression is released, the at least one elastic band retracts back to a minimum length and urges the side members back into the expanded configuration.

17 Claims, 9 Drawing Sheets

COLLAPSIBLE POLYHEDRON

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to game pieces, and more particularly to dice.

BACKGROUND

Dice have been used to determine gameplay for countless games for hundreds, if not thousands of years. Yet in all that time, dice have not been incorporated into the actual gameplay itself, apart from merely determining a random dice roll. One method for incorporating the dice into the game would be that the players have to slap the die, which is a method used in multiple card games when a particular card face is upright after the die has been cast. The problem with this, however, is that dice are ridged and this could lead to pain or injury for the player. However a die device that gives way when pressure is applied usually does not regain its shape, thus making it useless during fast-paced gameplay.

Therefore, there is a need for a die device that allows die to not only determine a random number during gameplay, but also to be incorporated into the game. Such a needed device would also be able to maintain its shape while still maintaining the flexibility needed to completely collapse when pressure is applied. The present invention accomplishes these objectives.

SUMMARY OF THE INVENTION

The present device is a collapsible, self-expanding polyhedron that is comprised of a plurality of side members, each having a polygonal outside face with a plurality of side edges. A side wall projects inwardly from each side edge, and at least one aperture traverses each sidewall. At least one elastic band traversed each side wall at one of the at least one aperture and is sized to urge each side wall of adjacent side members together to form an expanded configuration. When the collapsible self-expanding polyhedron is in the expanded configuration, the at least one elastic band retracts to a minimum length and each side member abuts at least one other side member so that each outside face abuts a plurality of other outside faces to form the polyhedron. When the polyhedron is compressed on two opposing side members, which causes the other side members to separate into a collapsed configuration, the at least one elastic band expands to a maximum length with maximum tension. Once the compression is released, the at least one elastic band retracts back to a minimum length and urges the side members back into the expanded configuration. Preferably, the collapsible, self-expanding polyhedron forms the shape of a regular polyhedron while in the expanded configuration, wherein each polygonal outside face of each side member is identical to form a regular polyhedron.

Another form the collapsible, self-expanding polyhedron may embody is a tetrahedron, wherein each polygonal outside face of each of four side members is a regular triangle. The collapsible, self-expanding polyhedron may also take the form of a cube, wherein each polygonal outside face of each of six side members is a square. Still further, the collapsible, self-expanding polyhedron forms an octahedron while in the expanded configuration, wherein each polygonal outside face of each of eight side members is a regular triangle. Another alternative form the collapsible, self-expanding polyhedron is that of a dodecahedron, wherein each polygonal outside face of each of twelve side members is a pentagon. Still further, the collapsible, self-expanding polyhedron may take the shape of an icosahedron, wherein each polygonal outside face of each of twenty side members is a regular triangle.

Alternatively, the collapsible, self-expanding polyhedron can form an irregular polyhedron, wherein at least two of the polygonal outside faces of the side members is different. One such variation is an irregular polyhedron such as a rhombicuboctahedron, wherein the polygonal outside faces of eighteen of the side members are squares, and the polygonal outside faces of eight of the side members are regular triangles. Another embodiment may include the collapsible, self-expanding polyhedron taking the form of the irregular polyhedron a truncated icosahedron, wherein the polygonal outside faces of twelve of the side members are pentagons, and the polygonal outside faces of twenty of the side members are hexagons. Still another embodiment of the collapsible, self-expanding polyhedron includes the polyhedron taking the shape of an icosidodecahedron wherein the polygonal outside faces of twenty of the side members are regular triangles, and the polygonal outside faces of twelve of the side members are pentagons. Other polyhedrons may be formed as well by altering the shape of the side members accordingly.

The present device allows a die to not only determine a random number during gameplay, but also be incorporated into the game in other ways. The present device is able to maintain its shape while still maintaining the flexibility needed to completely collapse when pressure is applied to opposing faces. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
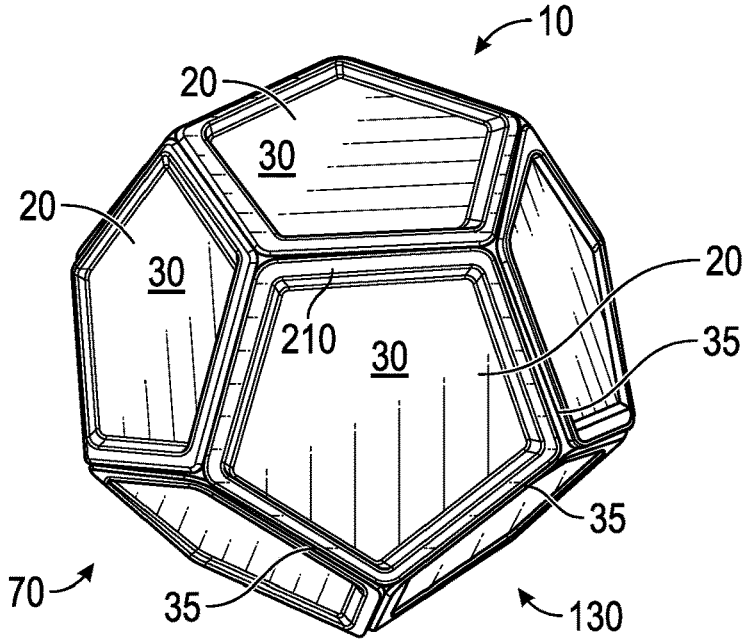
FIG. 1 is a top perspective view of the invention in an expanded configuration.
Figure 2:
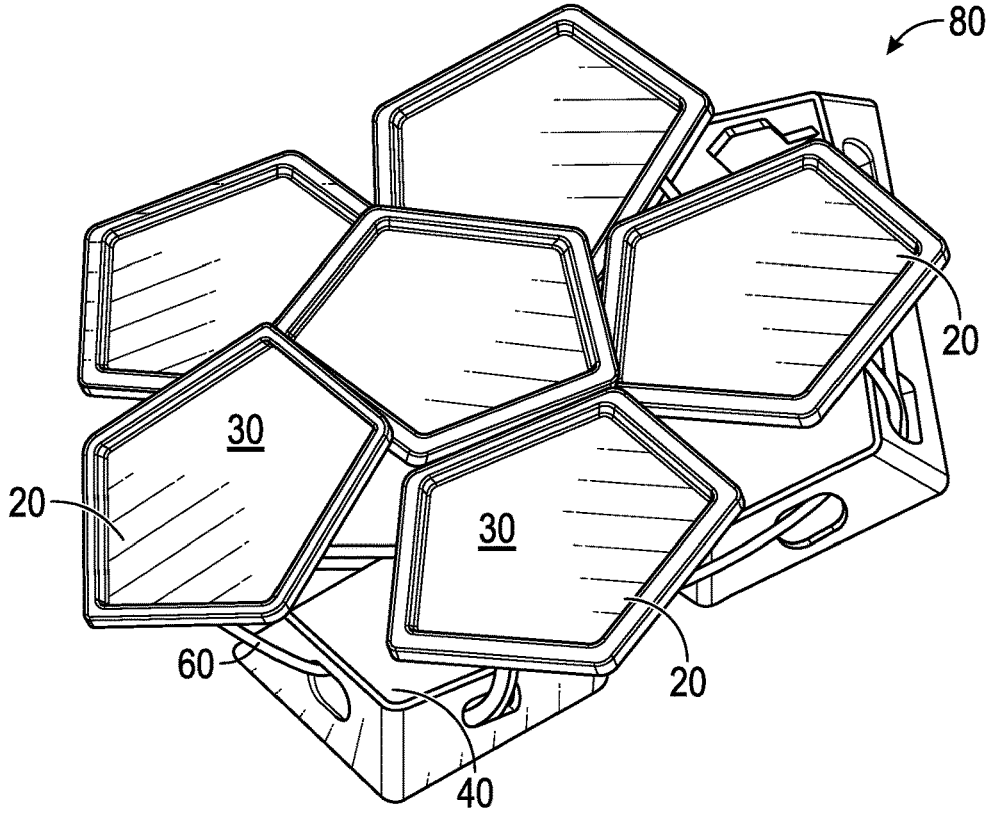
FIG. 2 is a top perspective view of the invention in a collapsed configuration.
Figure 3:
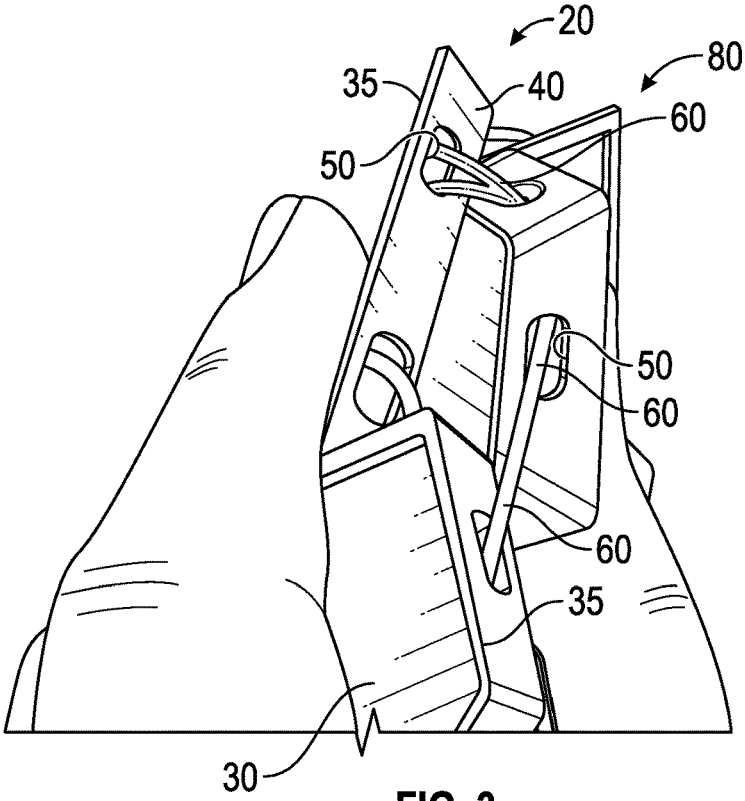
FIG. 3 is a close-up perspective view of elastic bands of the invention under tension, urging the invention into the expanded configuration but for pressure applied to opposing side members thereof.

FIGS. 1-3 show a collapsible, self-expanding polyhedron 10 that is comprised of a plurality of side members 20, each having a polygonal outside face 30 with a plurality of side edges 35. A side wall 40 projects inwardly from each side edge 35, and at least one aperture 50 traverses each side wall 40 (FIG. 1). The polygonal outside faces 30 can be any polygonal shape, including but not limited to, triangles, squares, pentagons, hexagons, and heptagons, as known to form three-dimensional polyhedrons. Ideally the side members 20 are each made with an injection molded, durable plastic, but such could also be made from any suitable rigid and durable material, such as wood, resin, or the like.

Figure 4A:
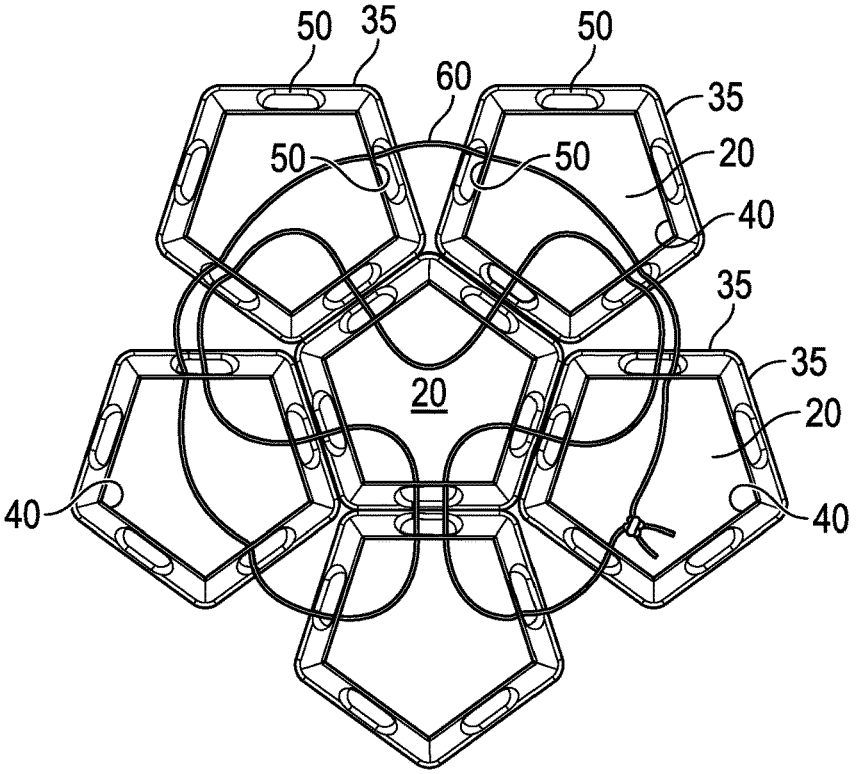
FIG. 4A is a top plan view of a portion of the invention in the collapsed configuration, during installation of one of the elastic bands.
Figure 4B:
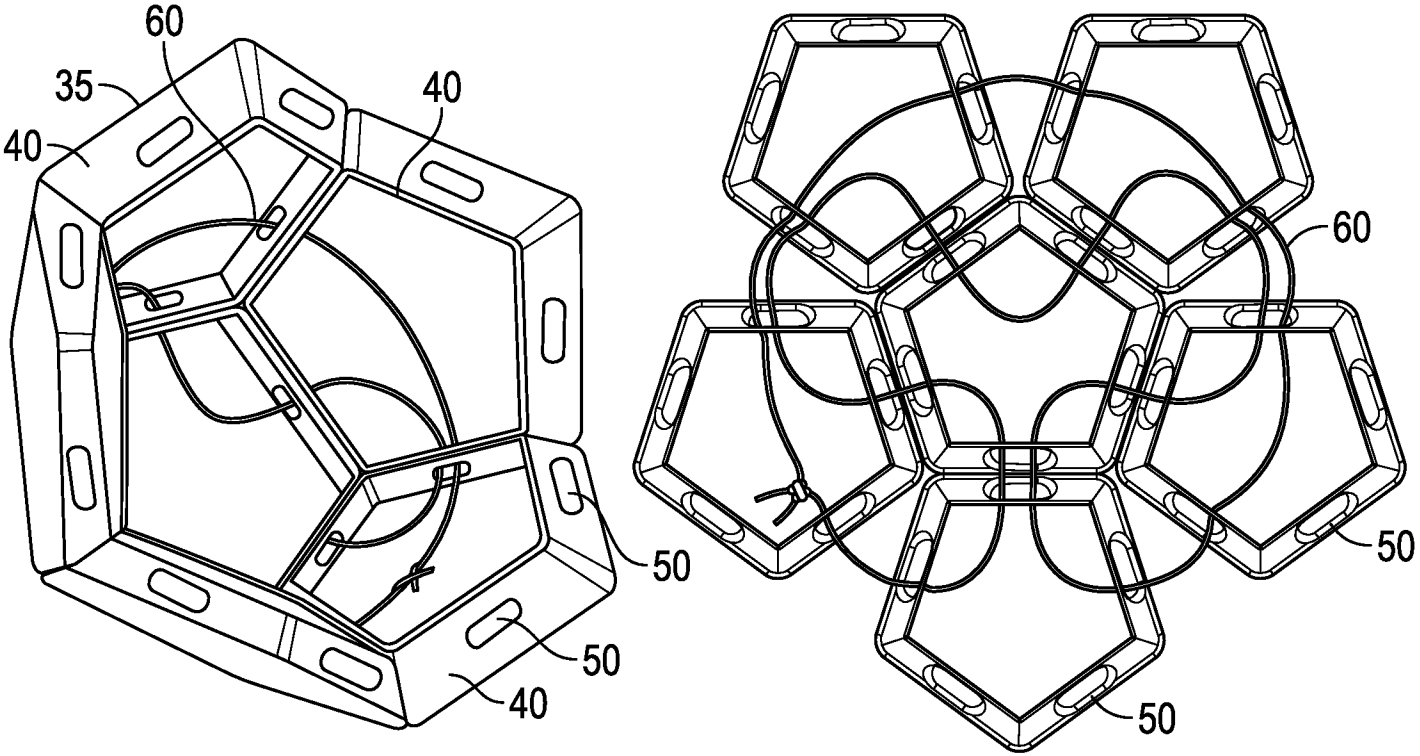
FIG. 4B is a perspective view of the invention showing one half of the polyhedron with one of the elastic bands installed, and another half of the polyhedron during installation of another of the elastic bands.
Figure 4C:
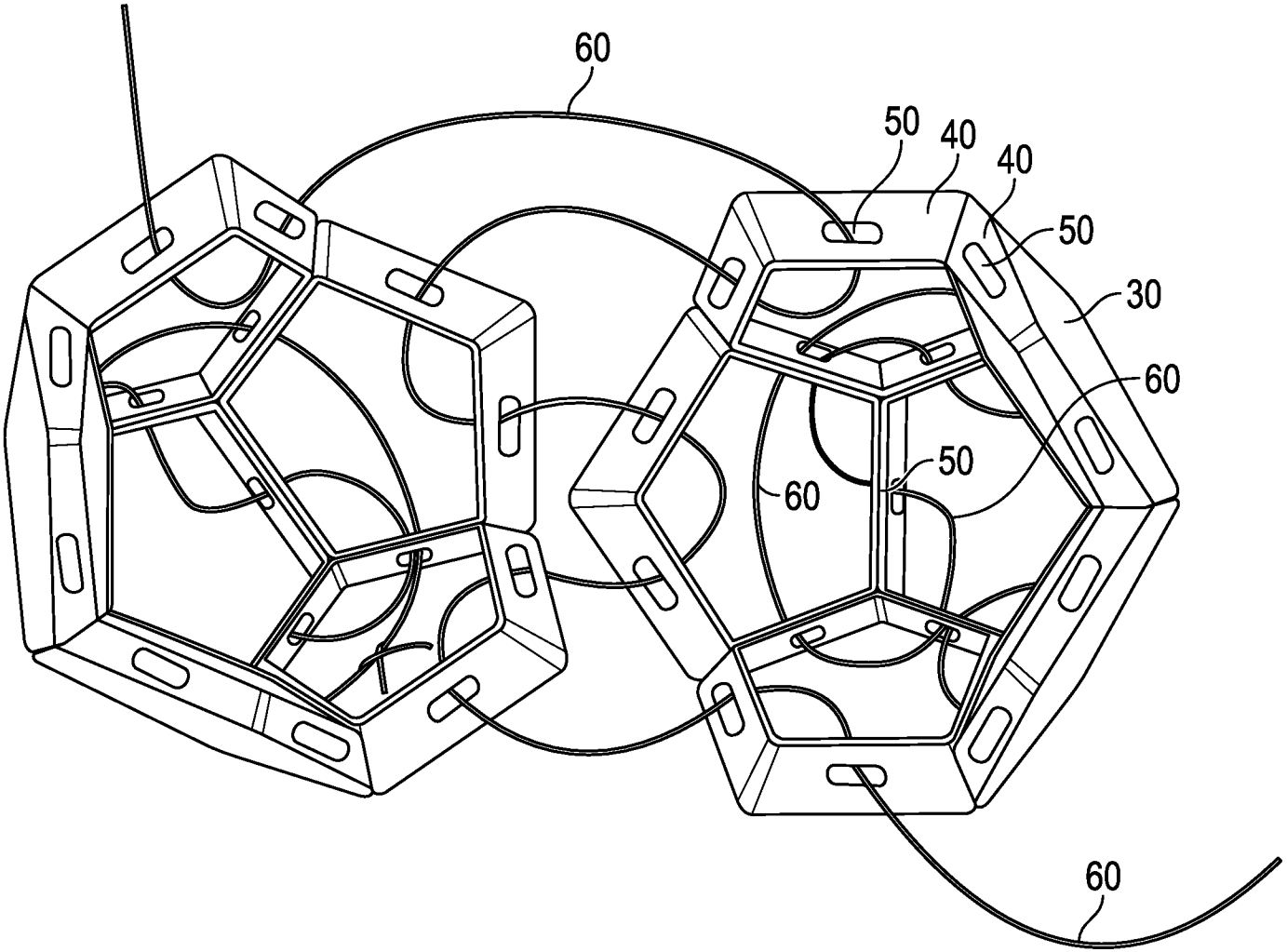
FIG. 4C is a perspective view of the invention showing the two halves of the polyhedron being fastened together with one of the elastic bands.

At least one elastic band 60 traverses each side wall 40 at one of the at least one apertures 50 and is sized to urge each side wall 40 of adjacent side members 20 together to form an expanded configuration 70 (FIGS. 4A-4C). When the collapsible self-expanding polyhedron 10 is in the expanded configuration 70, the at least one elastic band 60 retracts to a minimum length and each side member 20 abuts at least one other side member 20 so that each outside face 30 abuts a plurality of other outside faces 30 to form the polyhedron 10. When the polyhedron 10 is compressed on two opposing side members 20, such as with a user's hand, the other side members 20 collapse into a collapsed configuration 80, the at least one elastic band 60 expanding to a maximum length with maximum tension (FIGS. 2-3). Once the compression is released, the at least one elastic band 60 retracts back to the minimum length to cause the side members 20 to spring back into the expanded configuration 70. Such a polyhedron 10 may be utilized in game play, for example, by having players races to "smash" the polyhedron 10 die if a particular outside face 30 is face-up after rolling, or if some other event in the game transpires, such as if a particular card is displayed or a particular space is reached by a player on a game board (not shown).

Figure 5A:
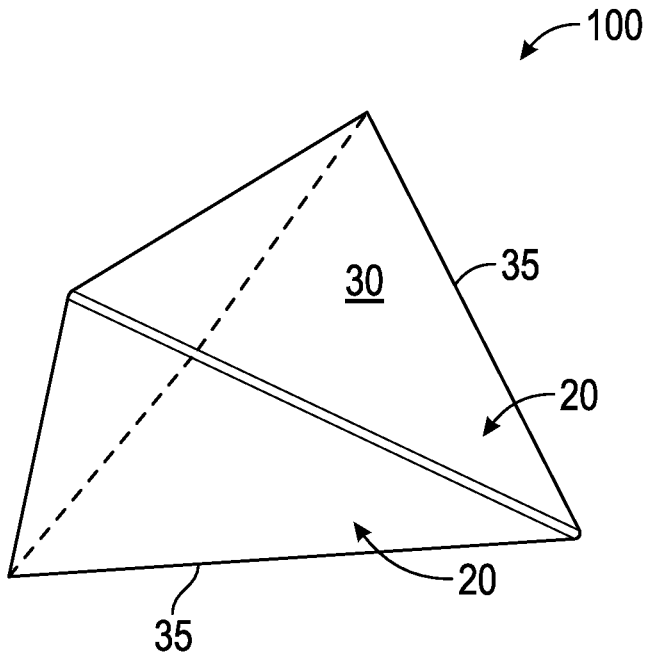
FIG. 5A is a perspective view of a tetrahedron embodiment of the invention.
Figure 5B:
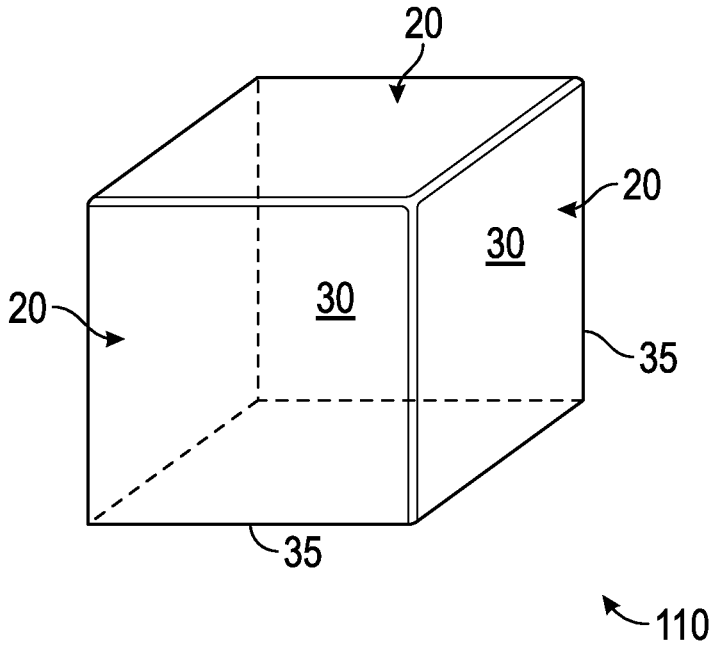
FIG. 5B is a perspective view of a cube embodiment of the invention.
Figure 5C:
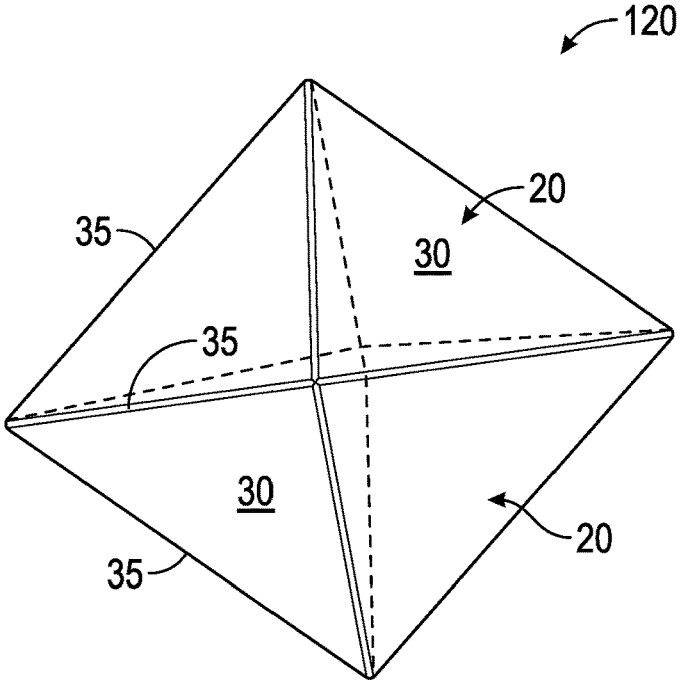
FIG. 5C is a perspective view of an octahedron embodiment of the invention.
Figure 5D:
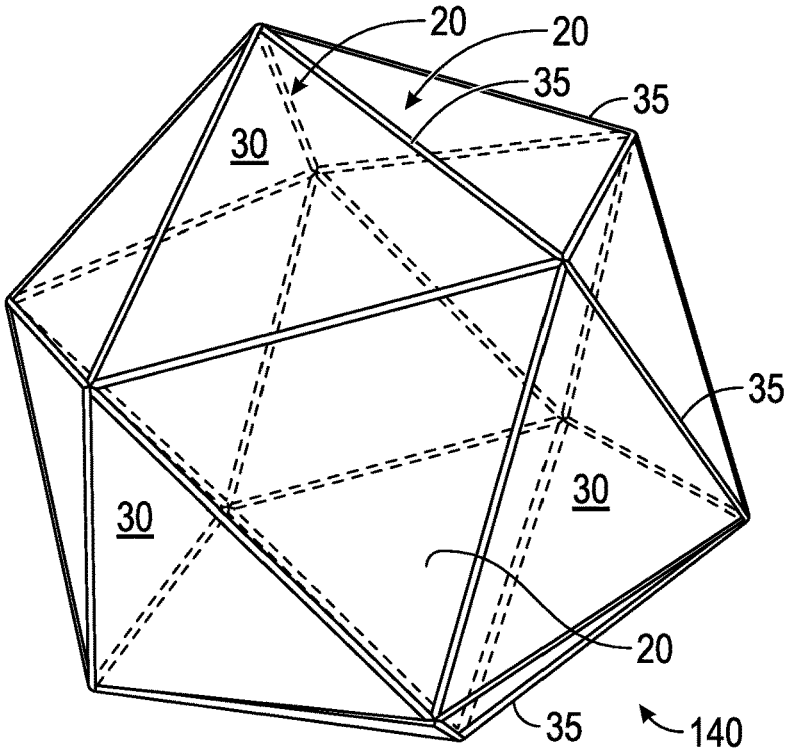
FIG. 5D is a perspective view of an icosahedron embodiment of the invention.

In some embodiments, the collapsible, self-expanding polyhedron 10 forms the shape of a regular polyhedron while in the expanded configuration 70, wherein each polygonal outside face 30 of each side member 20 is identical. For example, one form the collapsible, self-expanding polyhedron 10 may assume is a tetrahedron 100 (FIG. 5A), wherein each polygonal outside face 30 of each of four side members 20 is a regular triangle. The collapsible, self-expanding polyhedron 10 may also take the form of a cube 110 (FIG. 5B), wherein each polygonal outside face 30 of each of six side members 20 is a square. Still further, the collapsible, self-expanding polyhedron 10 may form an octahedron 120 (FIG. 5C) while in the expanded configuration 70, wherein each polygonal outside face 30 of each of eight side members 20 is a regular triangle. Another alternative form the collapsible, self-expanding polyhedron 10 may take is that of a dodecahedron 130 (FIG. 1), wherein each polygonal outside face 30 of each of twelve side members 20 is a pentagon. Still further, the collapsible, self-expanding polyhedron 10 may take the shape of an icosahedron 140 (FIG. 5D), wherein each polygonal outside face 30 of each of twenty side members 20 is a regular triangle.

Figure 5E:
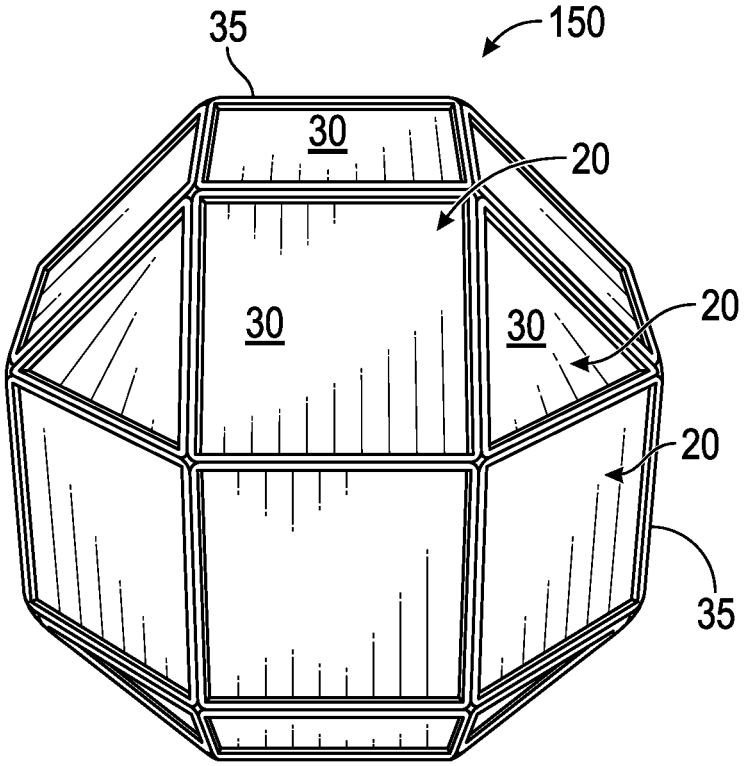
FIG. 5E is a perspective view of a rhombicuboctahedron embodiment of the invention.
Figure 5F:
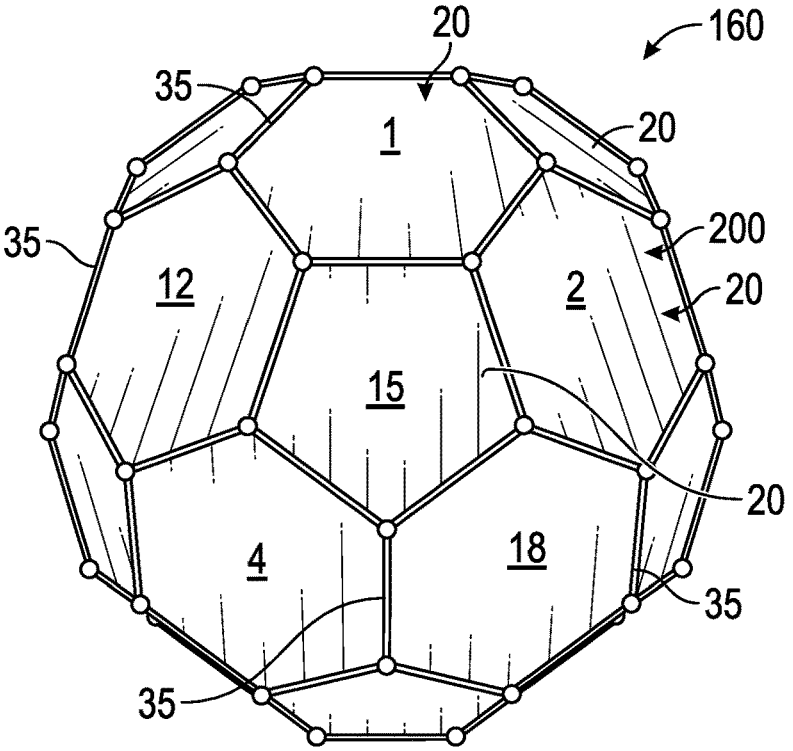
FIG. 5F is a perspective view of a truncated icosahedron embodiment of the invention.
Figure 5G:
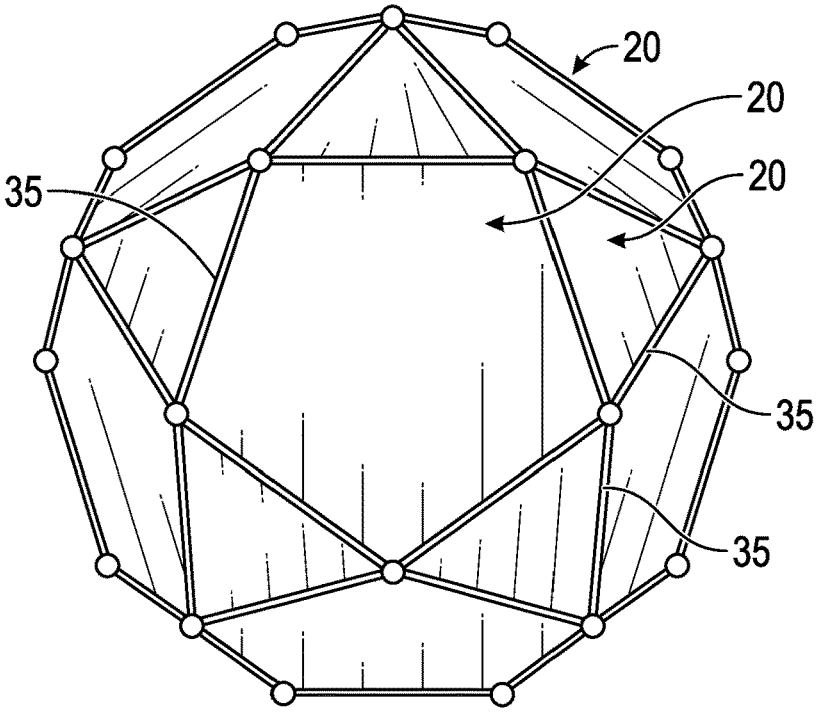
FIG. 5G is a perspective view of an icosidodecahedron embodiment of the invention.

Alternatively, the collapsible, self-expanding polyhedron 10 can form an irregular polyhedron, wherein at least two of the polygonal outside faces 30 of each of the side members 20 are different. One such variation, for example, is a rhombicuboctahedron 150 (FIG. 5E), wherein the polygonal outside faces 30 of eighteen of the side members 20 are squares, and the polygonal outside faces 30 of eight of the side members 20 are regular triangles. Another embodiment may include the collapsible, self-expanding polyhedron 10 taking the form of a truncated icosahedron 160 (FIG. 5F), wherein the polygonal outside faces 30 of twelve of the side members 20 are pentagons, and the polygonal outside faces 30 of twenty of the side members 20 are hexagons. Still another embodiment of the collapsible, self-expanding polyhedron 10 includes the polyhedron 10 taking the shape of an icosidodecahedron wherein the polygonal outside faces 30 of twenty of the side members 20 are regular triangles, and the polygonal outside faces 30 of twelve of the side members 20 are pentagons (FIG. 5G).

Another embodiment of the invention includes the outside faces 30 of at least one of the side members 20 having an indica 200, such as a symbol, number, letter, or the like. The collapsible, self-expanding polyhedron 10 may further include a raised rim 210 along each side edge of the polygonal outside faces 30 of each side member 20.

Figure 6:
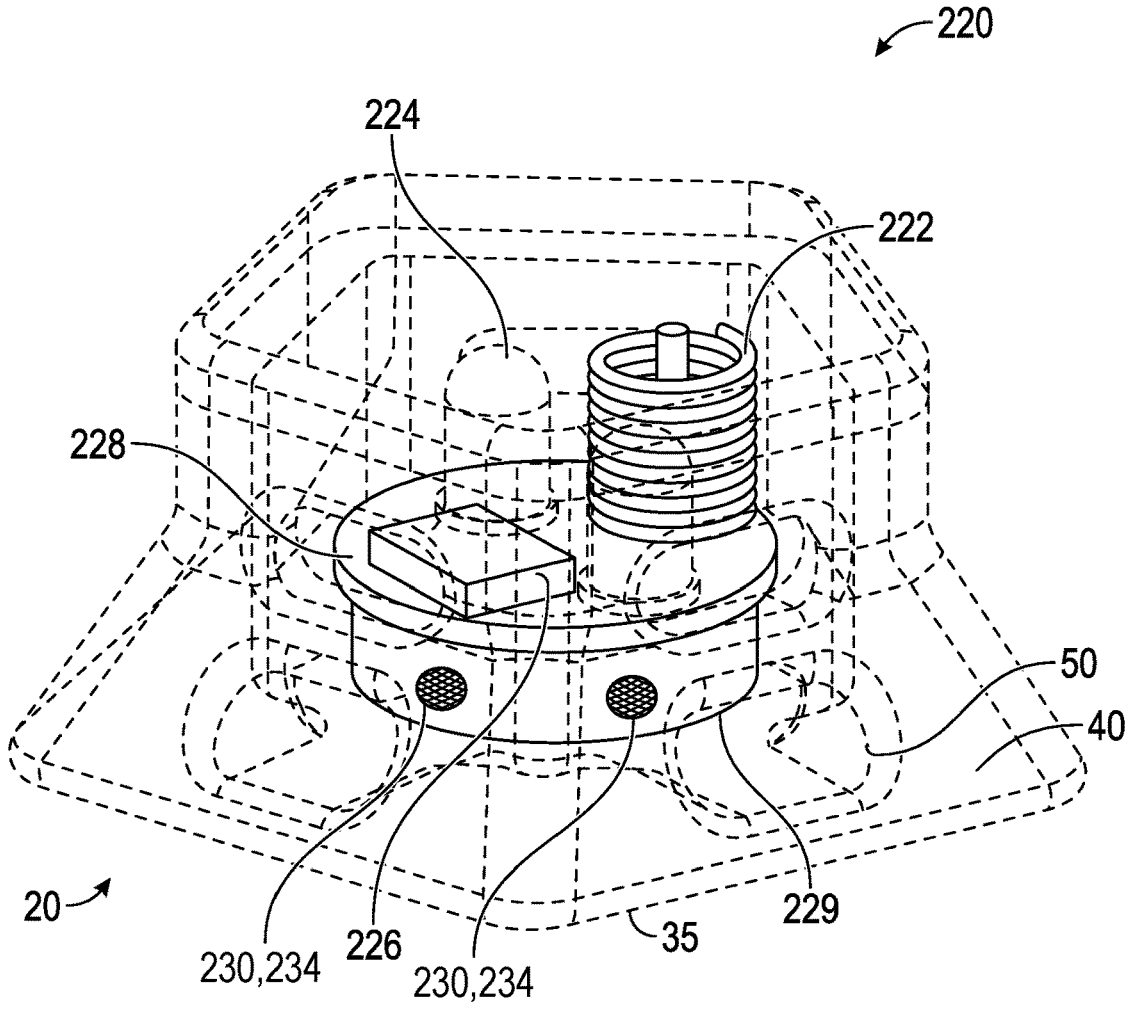
FIG. 6 is a perspective, internal view of an LEDs and audio transducer.

In some embodiments, the collapsible, self-expanding polyhedron 10 further includes an LED module 220 (FIG. 6) that has a motion-activated switch 222 that, when the polyhedron 10 is compressed into the collapsed configuration 80, causes a controller 226 to activate or flash a plurality of LEDs 224 for a preset duration. In such an embodiment, the side members 20 are preferably made from a non-opaque material (FIG. 6).

The collapsible, self-expanding polyhedron 10 may further include a sound module 230 which has a motion-activated switch 222 that, when the polyhedron 10 is compressed into the collapsed configuration 80, activates an audio transducer 234 for a preset duration. Such an audio transducer 234 may play a sound of breaking glass, a siren, dogs barking, or other sound as appropriate for the game being played. Both the LED module 220 and sound module 230 may share a printed circuit board 228 and controller 226 and be housed in a common housing (illustrated in broken lines in FIG. 6 for clarity of understanding).

Figure 7:
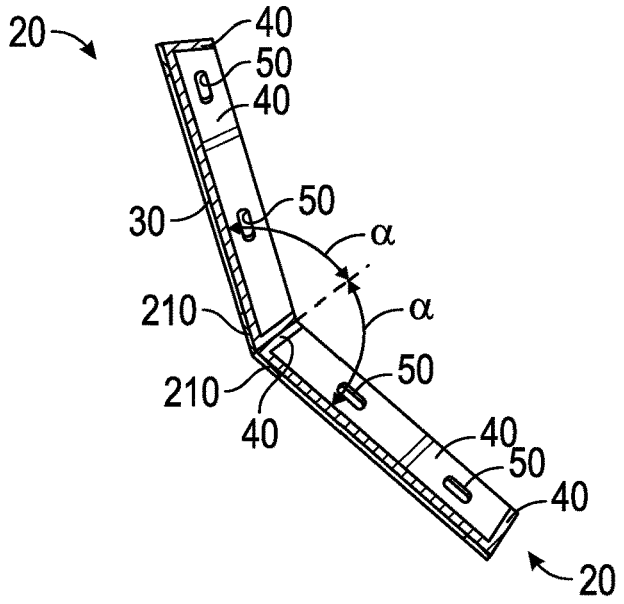
FIG. 7 is a partial cross-sectional view a dodecahedron embodiment of the invention, illustrating side walls of two abutting side members and angles formed therebetween.

To manufacture each side member 20, an angle $\alpha$ between the side wall 40 and the polygonal outside face 30 is typically determined by the formula 90−(180/n), where n is a number of polygonal outside faces 30 around an outside diameter of the polyhedron 10 (FIGS. 1 and 7). For example, with a dodecahedron as shown in FIG. 1, $\alpha$ is 90−(180/5), or 54-degrees.

While a particular form of the invention has been illustrated and described, it will be apparent that various modifications can be made without departing from the spirit and scope of the invention. For example, the polyhedron 10 could take other three-dimensional shapes not mentioned herein. Accordingly, it is not intended that the invention be limited, except as by the appended claims.

Particular terminology used when describing certain features or aspects of the invention should not be taken to imply that the terminology is being redefined herein to b restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A collapsible, self-expanding polyhedron comprising:

a plurality of side members, each side member having a polygonal outside face with a plurality of side edges, each side member further having a side wall projecting inwardly from each side edge of the polygonal outside face thereof, each side member further having at least one aperture traversing each side wall thereof; and at least one elastic band traversing each side wall of each side member at the at least one aperture and sized to urge each side wall of adjacent side members of the plurality of side members together;

whereby in an expanded configuration the at least one elastic band retracts to a minimum length and each side member abuts at least one other side member such that each polygonal outside face abuts a plurality of other polygonal outside faces to form the polyhedron, and wherein the polyhedron when compressed on two opposing side members of the plurality of side members thereof causes the side members to separate into a collapsed configuration to expand the at least one elastic band to a maximum length with maximum tension therein, whereby upon release the at least one elastic band urges the side members back into the expanded configuration.

2. The collapsible, self-expanding polyhedron of claim 1 wherein the polyhedron is a regular polyhedron, wherein each polygonal outside face of each side member is identical.

3. The collapsible, self-expanding polyhedron of claim 2 wherein the polyhedron is a tetrahedron, wherein each polygonal outside face of each of four side members is a regular triangle.

4. The collapsible, self-expanding polyhedron of claim 2 wherein the polyhedron is a cube, wherein each polygonal outside face of each of six side members is a square.

5. The collapsible, self-expanding polyhedron of claim 2 wherein the polyhedron is an octahedron, wherein each polygonal outside face of each of eight side members is a regular triangle.

6. The collapsible, self-expanding polyhedron of claim 1 wherein the polyhedron is a dodecahedron, wherein each polygonal outside face of each of twelve side members is a pentagon.

7. The collapsible, self-expanding polyhedron of claim 1 wherein the polyhedron is an icosahedron, wherein each polygonal outside face of each of twenty side members is a regular triangle.

8. The collapsible, self-expanding polyhedron of claim 1 wherein the polyhedron is an irregular polyhedron, wherein at least two of the polygonal outside faces of the side members are different.

9. The collapsible, self-expanding polyhedron of claim 8 wherein the polyhedron is a rhombicuboctahedron, wherein the polygonal outside faces of eighteen of the side members are squares, and the polygonal outside faces of eight of the side members are regular triangles.

10. The collapsible, self-expanding polyhedron of claim 8 wherein the polyhedron is a truncated icosahedron, wherein the polygonal outside faces of eighteen of the side members are squares, and the polygonal outside faces of eight of the side members are regular triangles.

11. The collapsible, self-expanding polyhedron of claim 1 wherein the polygonal outside face of at least one of the side members includes an indica.

12. The collapsible, self-expanding polyhedron of claim 1 wherein the polygonal outside face of each side member includes a raised rim along each side edge thereof.

13. The collapsible, self-expanding polyhedron of claim 1 further including an LED module having a motion-activated switch that, when the polyhedron is collapsed into the collapsed configuration, the LED module flashes a plurality of LEDs for a preset duration, each side member being made from a non-opaque material.

14. The collapsible, self-expanding polyhedron of claim 1 further including a sound module having a motion-activated switch that, when the polyhedron is collapsed into the collapsed configuration, the sound module activates an audio transducer for a preset duration.

15. The collapsible, self-expanding polyhedron of claim 1 wherein an angle between each side wall and the polygonal outside face of each side member is 90−180/N, N being the number of polygonal outside faces around an outside diameter of the polyhedron.

16. A collapsible, self-expanding polyhedron comprising:

a plurality of side members, each side member having a polygonal outside face with a plurality of side edges, each side member further having a side wall connected directly to and projecting inwardly from each side edge of the polygonal outside face thereof, each side member further having at least one aperture traversing each side wall thereof; and at least one elastic band traversing each side wall of each side member at the at least one aperture and sized to urge each side wall of adjacent side members of the plurality of side members together;

whereby in an expanded configuration the at least one elastic band retracts to a minimum length and each side member abuts at least one other side member such that each polygonal outside face abuts a plurality of other polygonal outside faces to form the polyhedron, and wherein the polyhedron when compressed on two opposing side members of the plurality of side members thereof causes the side members to separate into a collapsed configuration to expand the at least one elastic band to a maximum length with maximum tension therein, whereby upon release the at least one elastic band urges the side members back into the expanded configuration.

17. A collapsible, self-expanding polyhedron comprising:

a plurality of side members, each side member having a polygonal outside face with a plurality of side edges, each side member further having a side wall projecting inwardly from each side edge of the polygonal outside face thereof, each side member further having at least one aperture traversing each side wall thereof; and at least one elastic band traversing each side wall of each side member at the at least one aperture and sized to urge each side wall of adjacent side members of the plurality of side members together;

whereby in an expanded configuration the at least one elastic band retracts to a minimum length and each side member abuts at least one other side member such that each polygonal outside face abuts a plurality of other polygonal outside faces to form the polyhedron, and wherein the polyhedron when compressed on two opposing side members of the plurality of side members thereof causes the side members to separate into a collapsed configuration to expand the at least one elastic band to a maximum length with maximum tension therein, whereby upon release the at least one elastic band urges the side members back into the expanded configuration;

wherein an angle between each side wall and the polygonal outside face of each side member is 90−180/N, N being the number of polygonal outside faces around an outside diameter of the polyhedron.

* * * * *